US010834789B2

(12) United States Patent
Hu et al.

(10) Patent No.: US 10,834,789 B2
(45) Date of Patent: Nov. 10, 2020

(54) ELECTRONIC DOOR OPENING SYSTEM

(71) Applicant: WHIRLPOOL CORPORATION, Benton Harbor, MI (US)

(72) Inventors: Hanks Hu, ShenZhen (CN); Winner Wang, ShenZhen (CN); Hui Wu, ShenZhen (CN); Rongcan Yu, ShenZhen (CN)

(73) Assignee: Whirlpool Corporation, Benton Harbor, MI (US)

( * ) Notice: Subject to any disclaimer, the term of this patent is extended or adjusted under 35 U.S.C. 154(b) by 266 days.

(21) Appl. No.: 15/847,260

(22) Filed: Dec. 19, 2017

(65) Prior Publication Data

US 2019/0191498 A1 Jun. 20, 2019

(51) Int. Cl.

| | |
|---|---|
| ***H05B 6/64*** | (2006.01) |
| ***E05B 65/06*** | (2006.01) |
| ***E05F 15/616*** | (2015.01) |

(52) U.S. Cl.

CPC ..... *H05B 6/6417* (2013.01); *E05B 65/06* (2013.01); *E05F 15/616* (2015.01); *E05Y 2201/422* (2013.01); *E05Y 2201/438* (2013.01); *E05Y 2201/474* (2013.01); *E05Y 2201/686* (2013.01); *E05Y 2900/308* (2013.01)

(58) Field of Classification Search

CPC .... H05B 6/6414; H05B 6/6417; F24C 15/022
USPC ..... 219/424, 739; 312/319.1
See application file for complete search history.

(56) References Cited

U.S. PATENT DOCUMENTS

| | | | | |
|---|---|---|---|---|
| 4,340,799 | A | 7/1982 | Ueda et al. | |
| 4,450,335 | A | 5/1984 | Shimizu et al. | |
| 5,293,020 | A | 3/1994 | Han et al. | |
| 7,091,458 | B2 | 8/2006 | Lee et al. | |
| 7,755,004 | B2 | 7/2010 | Collene et al. | |
| 8,981,698 | B2 | 3/2015 | Fuhge | |
| 9,913,322 | B2 * | 3/2018 | Davies | H05B 6/6414 |
| 2011/0095019 | A1 | 4/2011 | Davies | |
| 2011/0139772 | A1 | 6/2011 | Darney | |
| 2013/0119838 | A1 | 5/2013 | Becker et al. | |

(Continued)

FOREIGN PATENT DOCUMENTS

| | | | |
|---|---|---|---|
| CN | 101990784 | A | 3/2011 |
| CN | 103562478 | A | 2/2014 |
| CN | 204063178 | U | 12/2014 |

(Continued)

*Primary Examiner* — Jennifer C Chiang
(74) *Attorney, Agent, or Firm* — Price Heneveld LLP

(57) ABSTRACT

An electronic door opening system for an appliance is provided. The door opening system includes a resilient member having a pin that moves in a linear direction to urge an appliance door open. The door opening system further includes a toothed gear member configured to engage with the resilient member. The gear member may be driven by a motor to move the resilient member to urge the door from a closed position to an open position. Accordingly, upon receipt of a door opening command received from a user interface, the motor drives the gear to engage with the resilient member and open the door. The door opening mechanism includes components that are free from contact with other systems of the appliance. For example, in a microwave oven, the door opening system components may be free from contact with a door latch and an interlock switch system.

18 Claims, 8 Drawing Sheets

(56) References Cited

U.S. PATENT DOCUMENTS

| | | | |
|---|---|---|---|
| 2017/0086261 | A1 | 3/2017 | Zhou |

FOREIGN PATENT DOCUMENTS

| | | | |
|---|---|---|---|
| CN | 205560879 | U | 9/2016 |
| CN | 205618004 | U | 10/2016 |
| EP | 2036401 | B1 | 10/2014 |
| JP | S5840433 | A | 3/1983 |
| JP | 2010197003 | A | 9/2010 |
| WO | 2009080229 | A2 | 7/2009 |
| WO | 2015185604 | A1 | 12/2015 |

* cited by examiner

ELECTRONIC DOOR OPENING SYSTEM

BACKGROUND OF THE DISCLOSURE

The present disclosure generally relates to electronic door opening mechanisms and systems.

SUMMARY OF THE INVENTION

According to one aspect, the disclosure provides a door opening system for an appliance. The appliance generally includes a housing, a door providing access to the housing, a latch system for retaining the door in a closed position and releasing the door to an open position, and an interlock switch system. The door opening system comprises a resilient member for urging the door from the closed position to the open position, wherein the resilient member is free from contact with the latch system and the interlock switch system. The door opening system also includes a gear member configured to engage with the resilient member to cause the resilient member to urge the door from the closed position to the open position, and a motor configured to drive the gear member. The door opening system further comprises a door opening command interface for receiving a door open command, and control circuitry configured to activate the motor upon receipt of a door open command from the door opening command interface.

In another aspect, the disclosure provides a microwave oven having a door opening mechanism. The microwave oven comprises a housing, a door providing access to the housing, a latch system for retaining the door in a closed position with respect to the housing and releasing the door to an open position with respect to the housing, a microwave source, and an interlock switch system for disabling the microwave source when the door is in the open position. The microwave oven further comprises a door opening mechanism including a resilient member for urging the door from the closed position to the open position, wherein the resilient member is free from contact with the latch system and the interlock switch system. The door opening mechanism further comprises a gear member configured to engage with the resilient member to cause the resilient member to urge the door from the closed position to the open position. The microwave oven includes a door opening command interface for receiving a door open command signal, and control circuitry configured to electronically activate the gear member upon receipt of a door open command signal.

In yet another aspect, the disclosure provides a system for opening a door of an appliance wherein the system comprises a door opening command interface, a resilient member for urging the door from a closed position to an open position, and control circuitry configured to activate the system after receiving a door opening command signal from the door opening command interface. The system also comprises a gear member configured to engage with the resilient member to cause the resilient member to urge the door from the closed position to the open position, and a motor configured to drive the gear member. Further, the resilient member is free from contact with a door latch system and an interlock switch system of the appliance.

These and other features, advantages, and objects of the present disclosure will be further understood and appreciated by those skilled in the art by reference to the following specification, claims, and appended drawings.

BRIEF DESCRIPTION OF THE DRAWINGS

Further advantages and features according to the present disclosure will become clear from the following detailed description provided as a non-limiting example, with reference to the attached drawings in which.

Figure 1A:
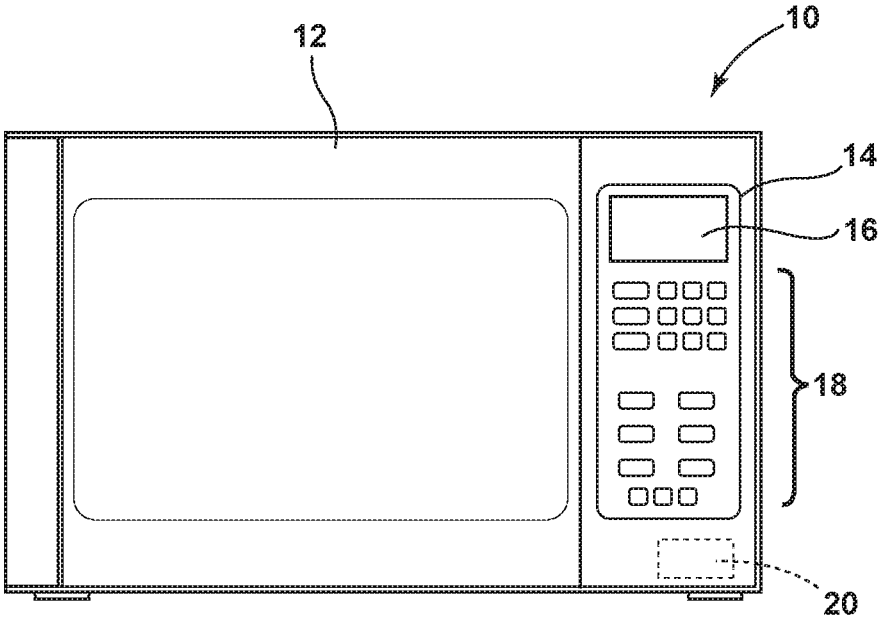
FIG. 1A depicts a front plan view of a microwave oven, according to an embodiment of the present disclosure.

The components in the figures are not necessarily to scale, emphasis instead being placed upon illustrating the principles described herein.

DETAILED DESCRIPTION

The present disclosure provides an electronic door opening system for an appliance, such as door opening system 30 (FIG. 3A) in microwave oven 10. The disclosed door opening system provides a mechanism to selectively open a door of the appliance, upon selection of a door open control by a user. More particularly, a user may provide a door opening command via a user interface that communicates with control circuitry within the appliance to operate the door opening system. The electronic opening system allows for a streamlined appearance on the appliance because the door open control may be incorporated with other user controls, eliminating the need for a door handle.

As described in more detail below, in some embodiments, a door opening system 30 (FIG. 2) may include a resilient member 32 that slides in a horizontal direction 64 to push a pin 36, a portion of resilient member 32, to urge a door 12 from a closed position to an open position. The resilient member 32 may be engaged by a gear member 50 to open door 12. Gear member 50 may be driven by a motor 56. Specifically, after receiving a door opening command, control circuitry 90 contained within the appliance may activate motor 56, or may activate a control gear stop switch 58 to activate motor 56, to drive gear member 50 in an engagement direction 60, and thereby engaging one or more gear teeth 52 with resilient member 32. Door opening system 30 may also be provided as free from contact with other mechanical and electrical door components, for example an interlock switch system 70 and a latch system 80. By separating door opening system 30 from other components of microwave oven 10, each component may be separately replaced upon failure, reducing maintenance costs. Further, the likelihood of the failure of any one component of door opening system 30, interlock switch system 70, or latch system 80 causing the failure of the other components is reduced. This and other embodiments will be described in more detail below.

The present illustrated embodiments reside primarily in combinations of system and apparatus components related to an electronic door opening mechanism for an appliance. Accordingly, aspects of the present disclosure have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

Figure 1B:
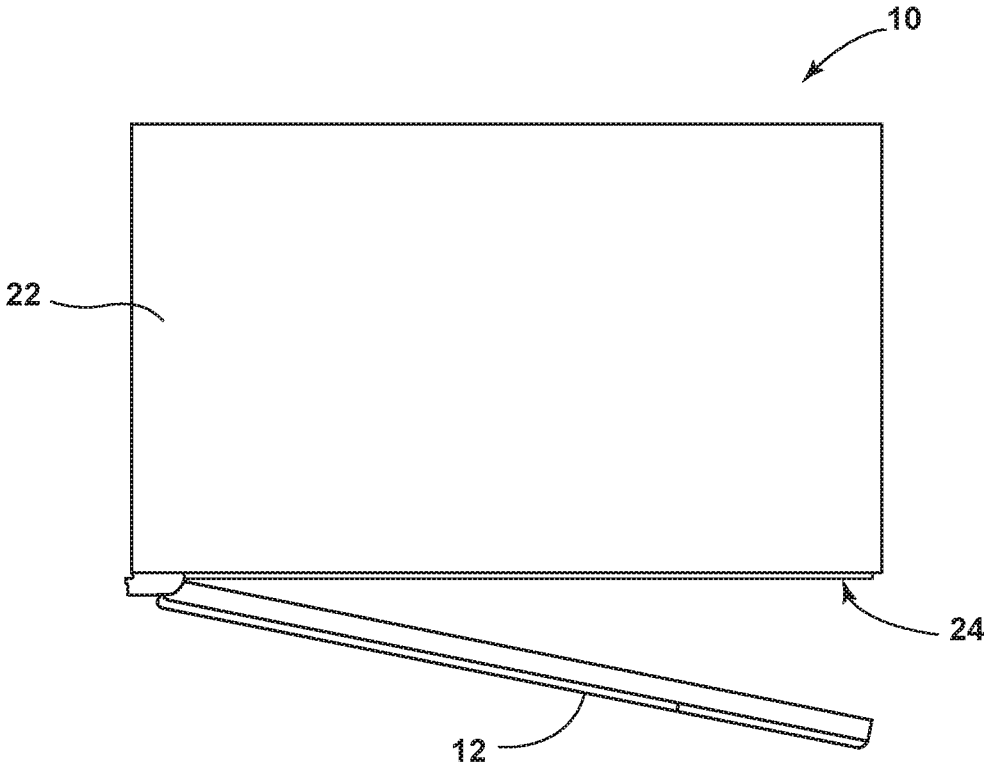
FIG. 1B depicts a top plan view of the microwave oven, according to an embodiment of the present disclosure.

FIGS. 1A and 1B depict an exemplary microwave oven 10 on which an embodiment of an electronic door opening system 30, as described herein, may be used. In at least one embodiment, microwave oven 10 includes an outer cabinet or housing 22 that incorporates one or move interior cavities (not shown) for cooking food items. Housing 22 may include a top surface, a pair of side surfaces, a back surface, and a bottom surface (surfaces not shown). Housing 22 may also include a front plate 24, which may align with a door 12, when door 12 is in a closed position. Door 12 of microwave oven 10 provides access to a cooking cavity (not shown) of microwave oven 10 such that when in an open position (FIG. 1B), the cooking cavity is accessed, and when in a closed position (FIG. 1A), the microwave oven 10 may be operated to heat food items.

As shown in the illustrated embodiment, microwave oven 10 may include a control panel interface 14, for controlling various functions of microwave oven 10. Control panel interface 14 may include a display 16, such as an LED numeric display, having a plurality of microwave oven control buttons 18, and a door opening command interface 20. Microwave control buttons 18 and door opening command interface 20 may be provided as any type of touch switch, touch sensor, such as a capacitive sensor, or any other type of touch switch components contemplated by a skilled artisan. As described in more detail below, microwave control buttons 18 and door opening command interface 20 may communicate with control circuitry 90 (FIG. 4) for operation of various cooking operations as well as for opening door 12 of microwave oven 10.

Figure 2:
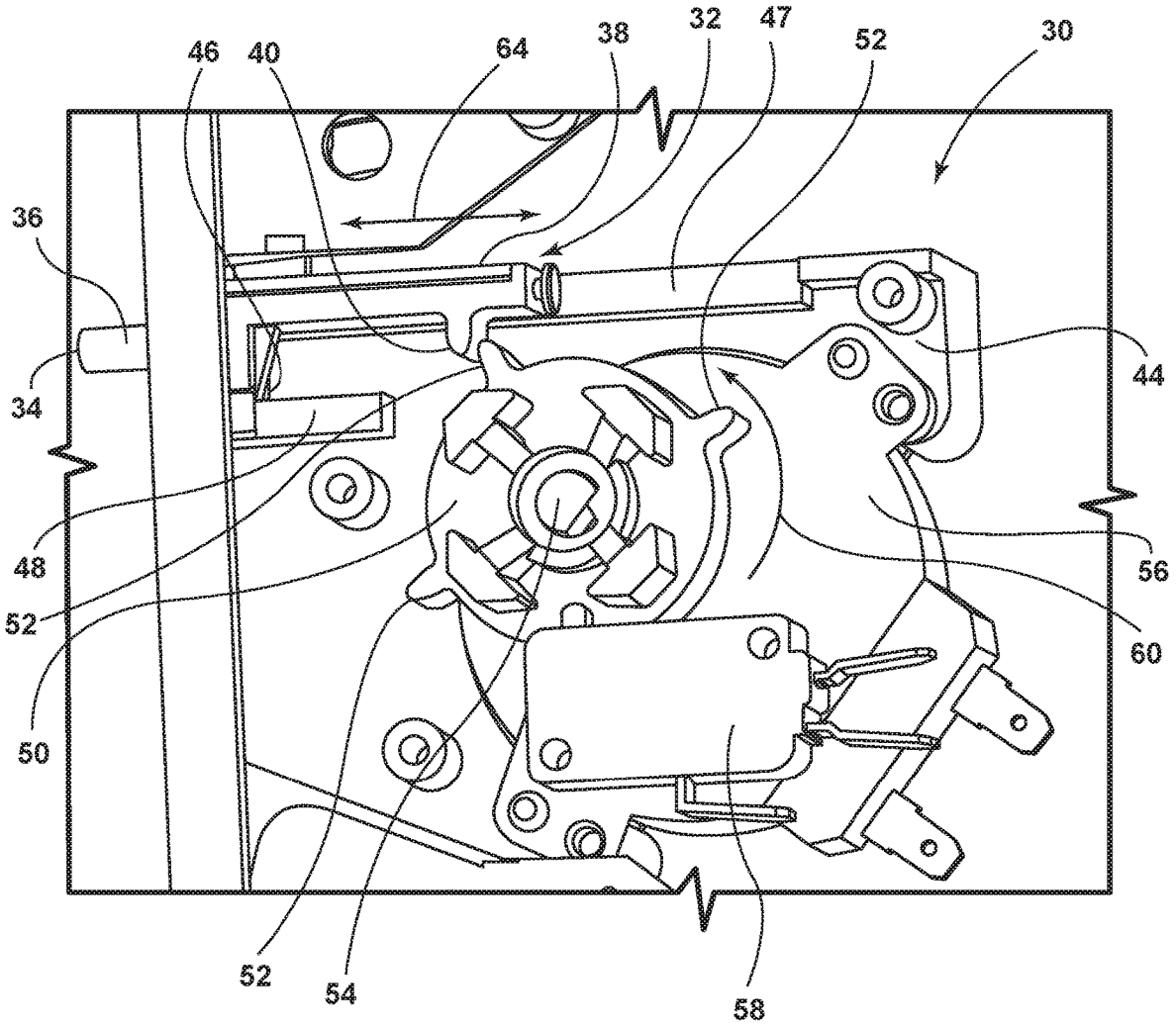
FIG. 2 depicts a partial view of an appliance having an electronic door opening mechanism, according to an embodiment of the present disclosure.
Figure 3A:
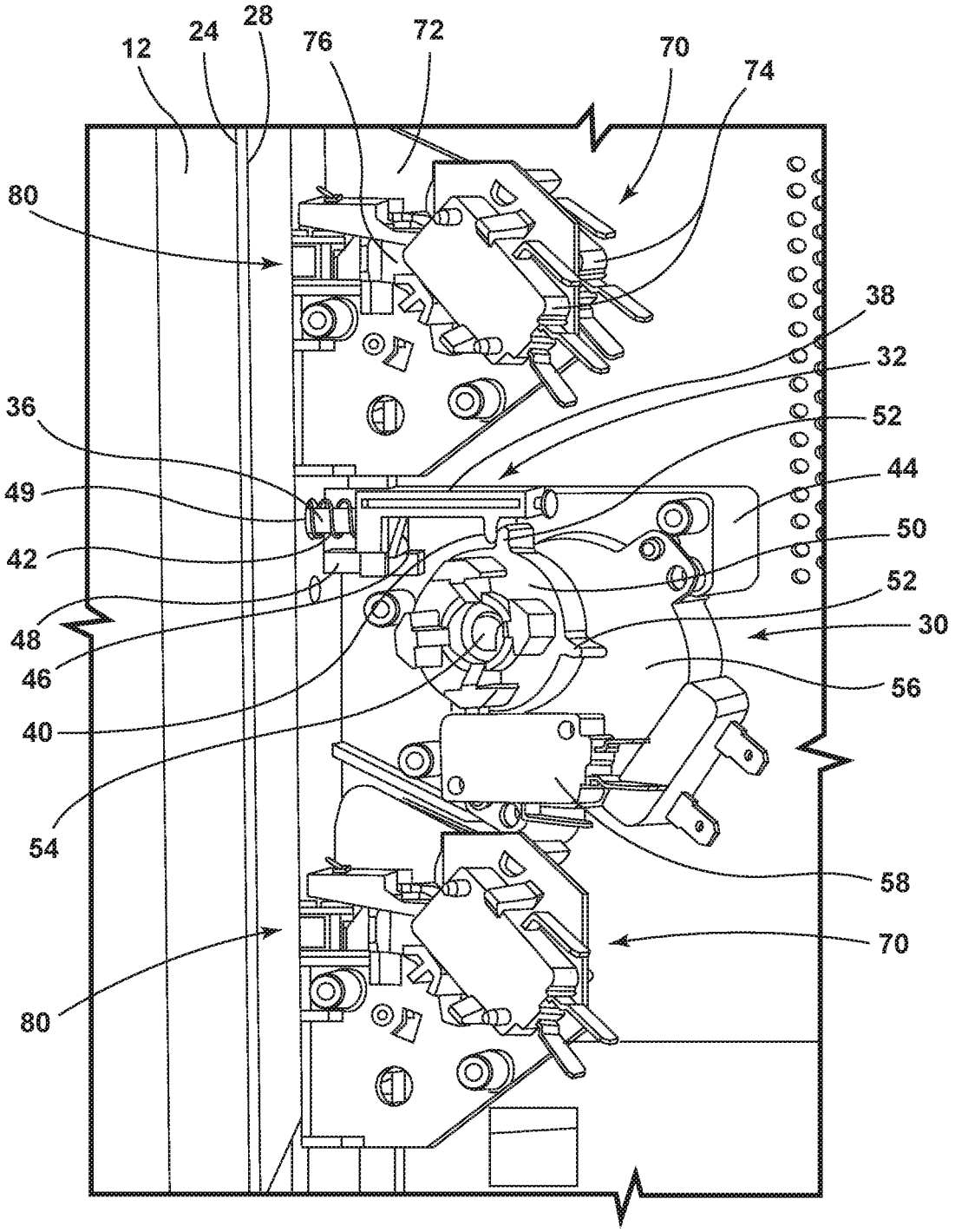
FIGS. 3A-3D depict an electronic door opening mechanism, according to an embodiment of the present disclosure, in various stages of displacement.

According to aspects described herein, microwave oven 10 may be provided with provisions to mechanically open door 12 via an electronic signal. More particularly, when a user activates a door open command via door opening command interface 20, control circuitry 90 of microwave oven 10 may activate a mechanical door opening system, such as door opening system 30 as depicted in FIG. 2. In some cases, door opening system 30 may include a rigid member that, when engaged with door 12, provides enough force to counteract a resistance provided by a latch system 80. In some cases such a system may be disposed within housing 22 of microwave oven 10, and in other cases the system may be disposed within door 12. In some cases, door opening system 30 may include a resilient member 32 disposed within housing 22 that abuts door 12 or otherwise interacts with door 12 to push it open. In at least one case a door opening system 30 may include a resilient member 32 driven by a gear member 50 disposed behind front plate 24 of housing 22, as shown in FIGS. 2-3D. Further, according to some embodiments, gear member 50 may be electronically controlled by a control gear stop switch 58 via one or more commands from control circuitry 90, as described in more detail below.

Referring to FIG. 2 of the illustrated embodiment, generally, door opening system 30 includes a resilient member 32, a gear member 50 for engaging with resilient member 32, a control gear stop switch 58, and a motor 56 for driving gear member 50. Door opening system 30 may further include a door opening system holder 44 for positioning of the various components of door opening system 30 behind front plate 24 of housing 22, or within microwave oven 10. Resilient member 32 includes a first end or abutment end 34, for abutting door 12. Resilient member 32 also includes a second end, or engagement end 38. Abutment end 34 may include a pin 36 configured to pass through an aperture 49 (FIG. 3A) to abut door 12 and urge it into an open position. Resilient member 32 may further include an engagement projection 40 for interacting with one or more gear teeth 52 of gear member 50, as described in more detail below. Resilient member 32 may be disposed at a top of door opening system holder 44 and specifically, along a lip 47 in door opening system holder 44. Door opening system holder 44 may further include a resilient member slide guide 48 for engaging a resilient member slide channel 46 disposed on resilient member 32. Referring to FIG. 3A, a biasing member 42 may be disposed along resilient member 32. In at least one case, biasing member 42 may comprise a biasing spring causing resilient member 32 to move away from front plate 24 when not being resisted or engaged toward front plate 24 and door 12.

Resilient member 32 may be configured to engage with a gear member 50 such that when gear member 50 is in motion, in an engagement direction 60, gear member 50 may engage with engagement projection 40 to push resilient member 32 along lip 47 and toward door 12. In some cases, gear member 50 may include a rotational gear having a plurality of gear teeth 52 that engage with engagement projection 40. In at least one case, gear member 50 includes four gear teeth 52, evenly spaced around a substantially circular gear member 50.

Gear member 50 may be connected to motor 56 via a central motor connection 54. Accordingly, motor 56 may be activated to drive gear member 50 in either engagement direction 60 or reset direction 62 (FIG. 3D), when activated by control gear stop switch 58. As described in more detail below, control gear stop switch 58 may be communicably coupled to control circuitry 90 for controlling motor 56.

Microwave oven 10 may further include a system for interrupting the production of microwave energy or heating when door 12 is opened. In some cases, an interlock switch 74 may be provided to notify control circuitry 90 (FIG. 4) when door 12 moves from a closed position to an open position, to interrupt microwave heating. In at least one case, an interlock switch system 70 may be provided with an associated latch system 80. Also, latch system 80 may be configured to retain door 12 in a closed position with respect to housing 22, and to release door 12 to an open position with respect to the housing, As depicted, interlock switch system 70 and latch system 80, while electronically interacting with door opening system 30, may be separate and free from contact with door opening system 30. Accordingly, the risk of all components of door opening system 30, interlock switch system 70, and latch system 80 failing at one time is reduced.

In at least one embodiment, microwave oven 10 includes a pair of interlock switch systems 70, i.e., one associated with each of a pair of door latches 82 in latch system 80. Specifically, interlock switch systems 70, may be situated at both an upper portion of rear side 28 and a bottom portion of rear side 28 of front plate 24. As would be contemplated by a skilled artisan, components of an interlock switch system 70 may be disposed on or held by an interlock switch system holder 72 and may include an interlock switch 74 and a cam plate 76. Cam plate 76 may be configured to interact with latch system 80, and specifically, to open interlock switch 74 when door 12 is in an open position. Specifically, when door 12 is in a closed position, as in FIGS. 3A and 3B, a latch 82 presses against a latch plate 84, and cam plate 76 is rotated against interlock switch 74. However, when door 12 is opened, as in FIGS. 3C and 3D, latch 82 is out of housing 22, such that latch plate 84 is released to a rear side 28 of front plate 24, causing cam plate 76 to rotate in rotation direction 78 and to open interlock switch 74. As described in more detail below, when interlock switch 74 is open, microwave oven 10 controls are shut off by control circuitry 90 for safety. It should be understood that the present disclosure is not limited to the interlock switch system 70 and latch system 80 embodiments described herein. Those skilled in the art will appreciate the many different configurations that may accomplish the functions of an interlock switch and door latch, and the present disclosure will be understood to include any such alternative configurations.

Figure 3B:
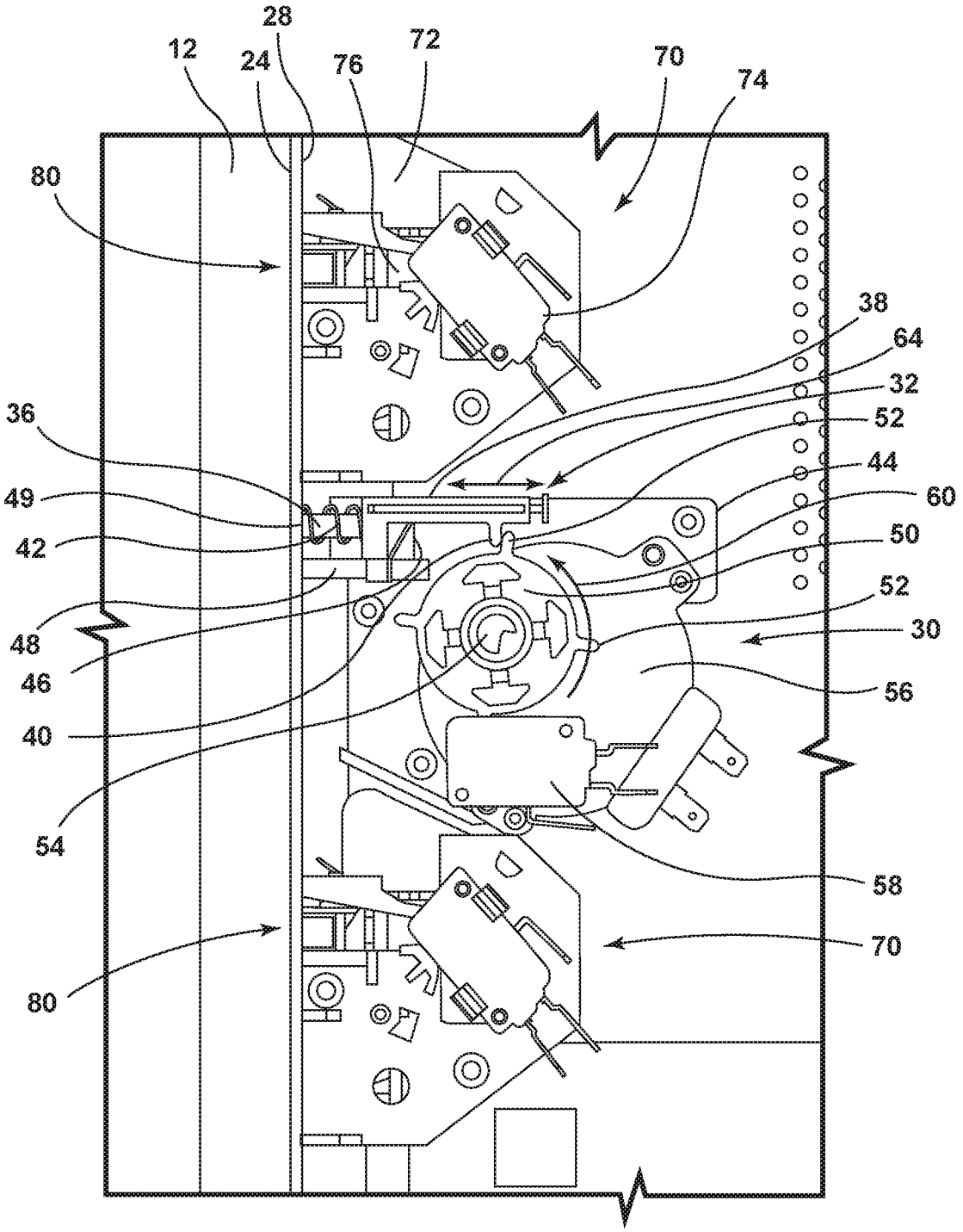
Figure 3C:
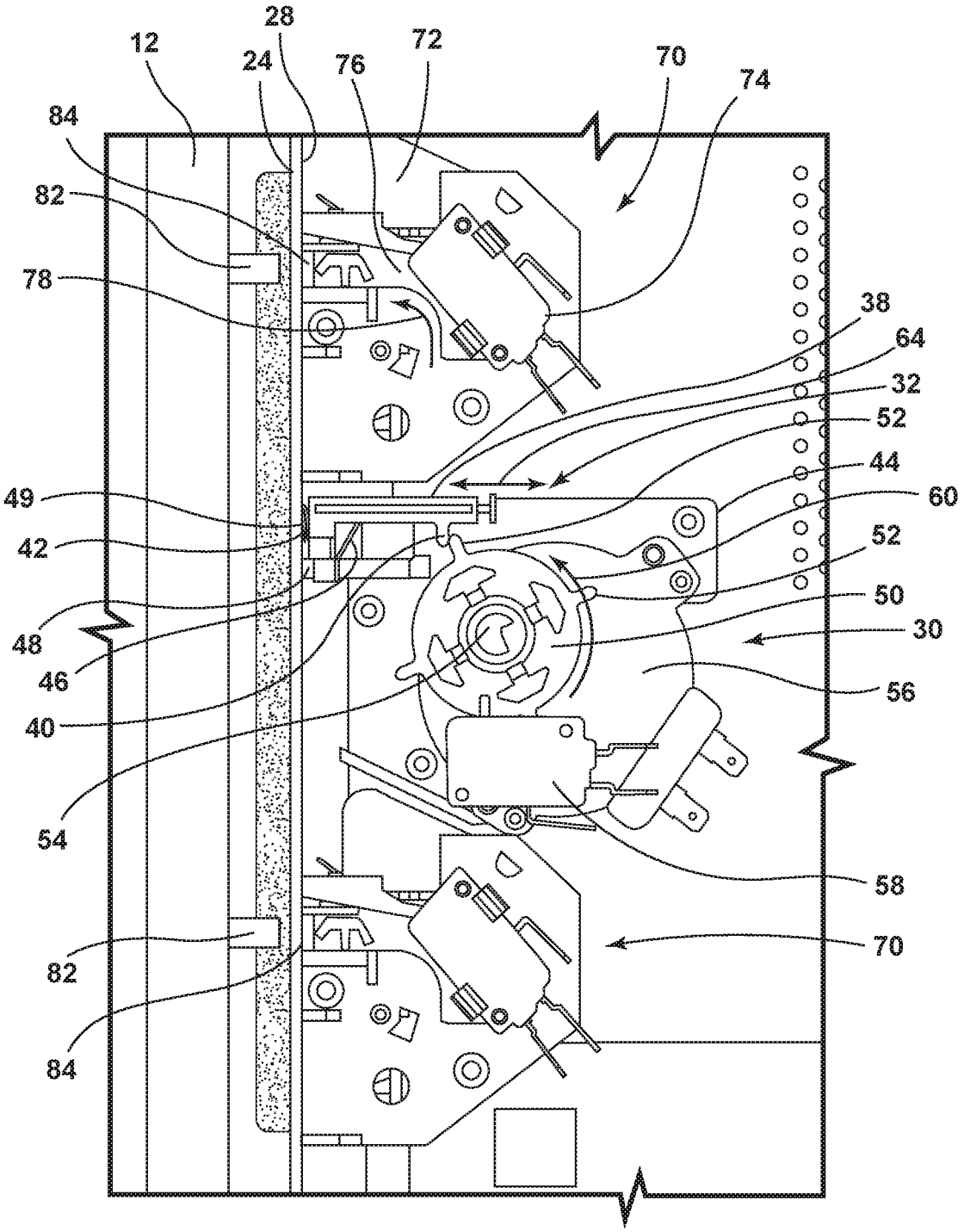
Figure 3D:
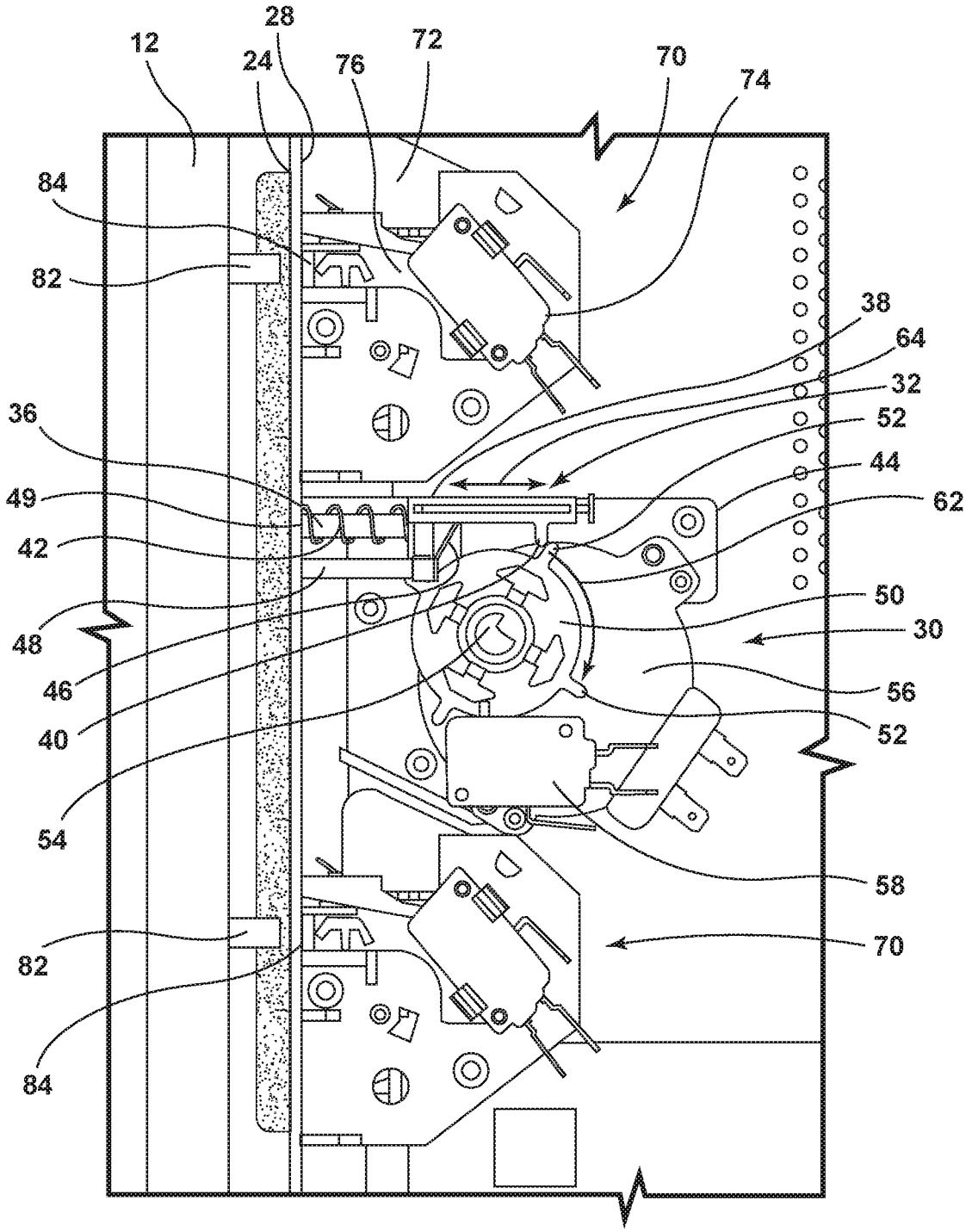

FIGS. 3A-3D depict the operation of door opening system 30, according to an embodiment described herein. Specifically in FIG. 3A, a resilient member 32 is biased away from rear side 28 of front plate 24, and gear member 50 is in a reset position. Further, cam plate 76 is rotated to the right or toward interlock switch 74 such that interlock switch 74 is in a closed position to allow for uninterrupted heating operations within microwave oven 10. Upon receiving control instructions from control circuitry 90, control gear stop switch 58 may activate motor 56 to rotate gear member 50. Referring to FIG. 3B, as gear member 50 begins to rotate in engagement direction 60, at least one gear tooth 52 may engage with engagement projection 40 to move resilient member 32 in horizontal movement direction 64. The engagement of resilient member 32 moves pin 36 through aperture 49, pressing abutment end 34 against door 12 to urge door 12 from a closed position to an open position. Referring to FIG. 3D, after the gear tooth 52 moves past engagement projection 40, pressure is no longer being applied to engagement projection 40, and biasing member 42 causes resilient member 32 to spring, or bias, back in horizontal movement direction 64, or to a reset position.

When door 12 is urged into an open position by resilient member 32, control circuitry 90 may receive a signal from interlock switch 74, as described in more detail below. In addition, control circuitry 90 may be configured to cause control gear stop switch 58 to stop activation of motor 56. In some cases control gear stop switch 58 may also activate motor 56 to move gear member 50 in reset direction 62, as shown in FIG. 3D, to ensure that gear teeth 52 are in proper position for engaging resilient member 32 in a future door opening operation.

Figure 4:
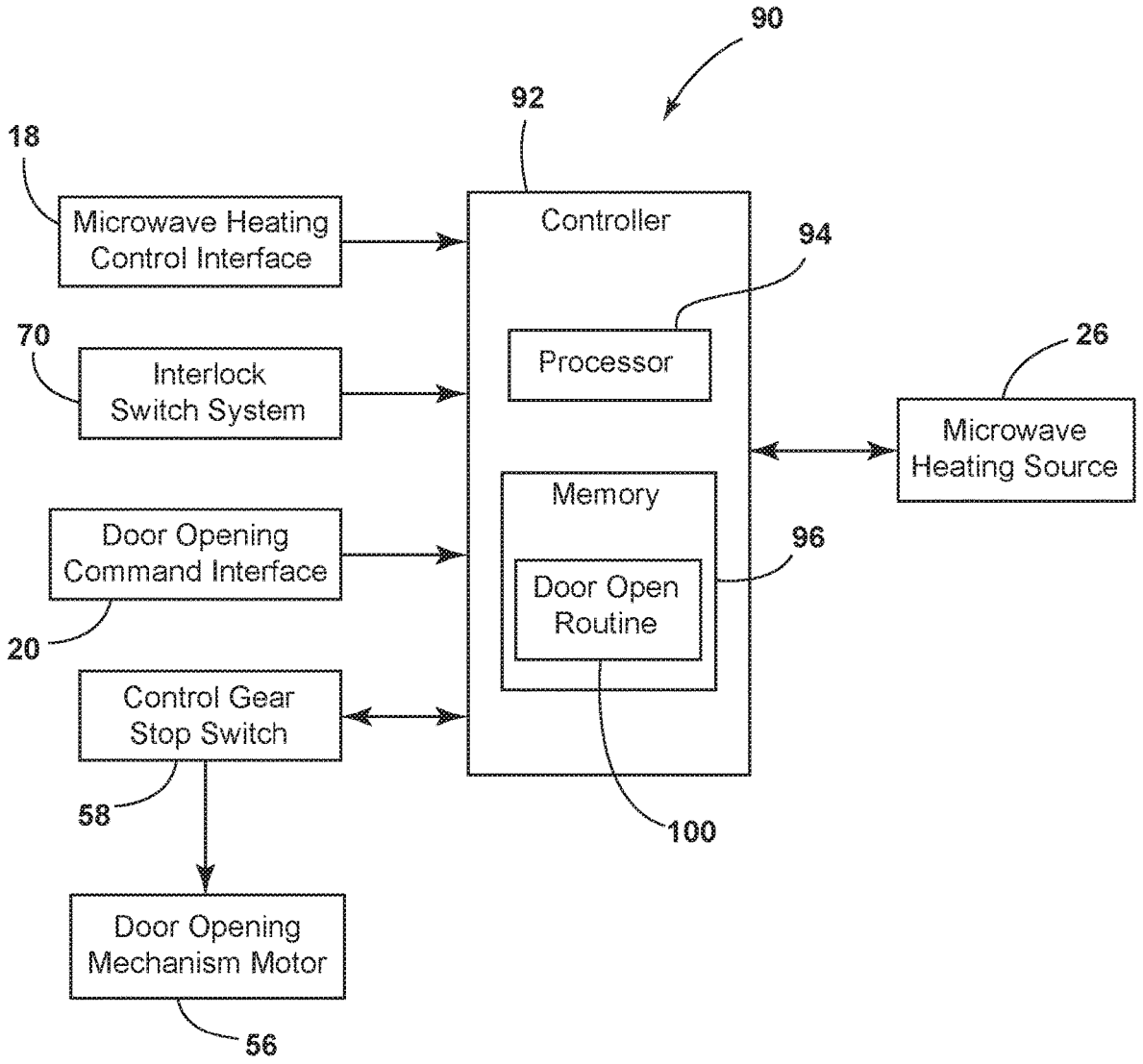
FIG. 4 depicts a schematic of control circuitry of a microwave oven, according to an embodiment of the present disclosure.

As described above, in at least some embodiments, microwave oven 10 may include control circuitry 90 coupled to and configured to communicate with and control various components and systems of microwave oven 10. For example, FIG. 4 depicts an exemplary and simplified controller 92 which may be configured to receive inputs from various components of microwave oven 10, such as various sensors and systems, and also to control a variety of components in microwave oven 10, such as cooling microwave heating source 26, door opening mechanism motor, lights, sounds, and other components as would be known by a skilled artisan. In the illustrated embodiment, for example, controller 92 may be configured to activate door opening mechanism motor 56, either directly or by way of control gear stop switch 58, based on a user touching, depressing or otherwise initiating a door open command signal on door opening command interface 20.

Controller 92 may be configured as would be understood in the art, and at the very least includes a processor 94 and memory 96. Processor 94 may be configured to run various control algorithms and routines present in memory 96, such as door open routine 100 and other microwave heating routines. It should also be understood and appreciated that controller 92 may include various other analog or digital circuitries contemplated by a skilled artisan, and the depiction in FIG. 4 is for illustrative purposes only, and is simplified for understanding of the concepts pertinent to aspects described herein.

Controller 92 may be coupled to a variety of sensors, switches, and systems within microwave oven 10. In at least one embodiment, microwave oven 10 includes a variety of components associated with a door opening system 30 that may communicate with controller 92, as described above. For example, microwave oven 10 may include one or more interlock switch systems 70, a door opening command interface 20, a control gear stop switch 58, and a door opening mechanism motor 56. Controller 92 may also communicate with a microwave heating control panel interface 14 to control a microwave heating source 26. As noted, however, FIG. 4 is a simplified depiction of a controller 92 associated with microwave oven 10, and it will also be appreciated that microwave oven 10 may include a variety of other known sensors, switches and systems for gathering information for controller 92, or for controlling various aspects of microwave oven 10, including the systems and processes described herein as well as those not discussed herein.

Controller 92 may be configured to receive inputs from the various sensors and systems to make decisions and control aspects or various components of microwave oven 10. In one aspect, controller 92 may receive door opening command from door opening command interface 20. Such inputs may inform various control routines, such as door open routine 100, as described in more detail below. The various inputs may also facilitate the control of components, such as the activation of door opening mechanism motor 56 and the suspension of microwave heating by microwave heating source 26.

Figure 5:
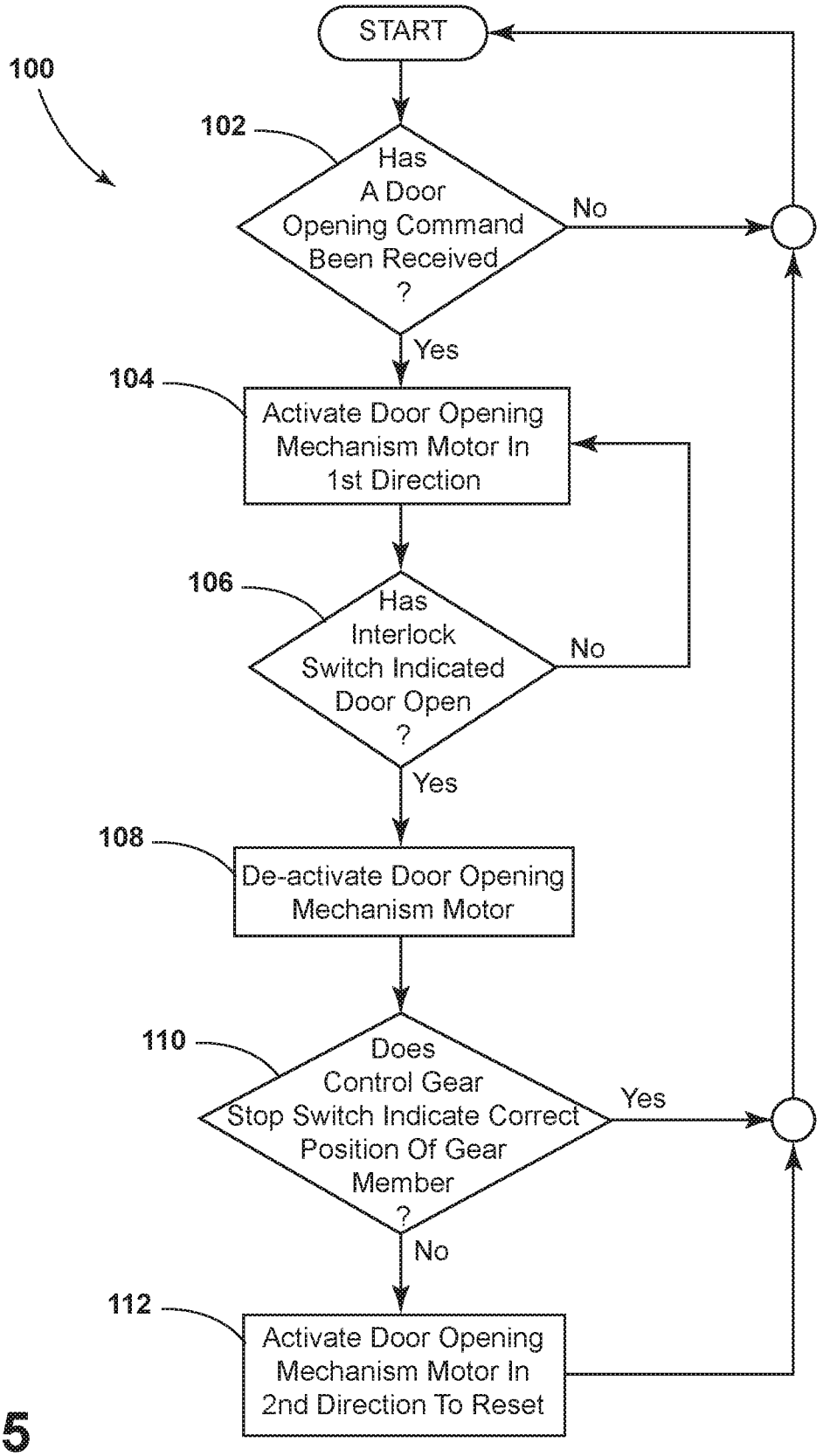
FIG. 5 depicts a flow chart of a door open routine, according to an embodiment of the present disclosure.

Referring to FIG. 5, door open routine 100 may be implemented by controller 92 according to an embodiment described herein. Specifically, at step 102, controller 92 may first receive input from door opening command interface 20 to open door 12. At step 104, after receiving a door open command, controller 92 causes control gear stop switch 58 to activate door opening mechanism motor 56 in a first direction, i.e. a direction associated with opening door 12, to open door. At step 106, door open routine 100 will cause controller 92 to determine if an interlock switch system 70 has indicated that door 12 has been opened. If not, door open routine 100 may continue looping through step 104. If door interlock switch system 70 indicates that door 12 has been opened at step 106, controller 92 causes control gear stop switch 58 to de-activate the door opening mechanism motor 56 at step 108. Next, at step 110, controller 92 may determine, based on feedback from control gear stop switch 58, if gear member 50, including gear teeth 52, are in a correct position for a subsequent door opening operation. If so, door open routine 100 returns to START. However, if not, controller 92 may cause control gear stop switch 58 to activate door opening mechanism motor 56 in a second direction, i.e. a direction associated with a reset position.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes, and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

It is also to be understood that variations and modifications can be made on the aforementioned structures and methods without departing from the concepts of the present disclosure, and further it is to be understood that such concepts are intended to be covered by the following claims unless these claims by their language expressly state otherwise.

What is claimed is:

1. A door opening system for an appliance, wherein the appliance includes a housing, a door providing access to the housing, a latch system for retaining the door in a closed position and releasing the door to an open position, and an interlock switch system, the door opening system comprising:

a door opening command interface;

a resilient member for urging the door from the closed position to the open position, wherein the resilient member is free from contact with the latch system and the interlock switch system, and wherein the resilient member moves through an aperture in said housing to urge the door from the closed position to the open position;

a gear member configured to engage with the resilient member to cause the resilient member to urge the door from the closed position to the open position; and a motor configured to drive the gear member;

control circuitry configured to activate the motor upon receipt of a door open command signal from the door opening command interface.

2. The door opening system of claim 1, wherein:

the resilient member comprises a pin.

3. The door opening system of claim 2, wherein:

the pin moves in a substantially horizontal direction to push the door from the closed position to the open position.

4. The door opening system of claim 1, wherein the resilient member comprises:

a first end configured to contact the door; and a second end configured to engage with the gear member.

5. The door opening system of claim 1, wherein:

the gear member comprises a plurality of teeth for engaging the resilient member; and the motor is configured to rotate the gear member to engage the resilient member with at least one of the plurality of teeth.

6. The door opening system of claim 5, further comprising:

a biasing member coupled to the resilient member, wherein the biasing member is configured to maintain the resilient member in a position free from contact with the door until engagement; and wherein:

engagement of the resilient member with a first tooth of the gear pushes the resilient member into contact with the door to urge the door from the closed position to the open position; and after engagement, the biasing member causes the resilient member to return to the position free from contact with the door.

7. The door opening system of claim 6, wherein:

the biasing member comprises a spring.

8. The door opening system of claim 1, wherein:

the control circuitry is further configured to de-activate the motor upon receipt of a door open signal from said interlock switch system of said appliance.

9. The door opening system of claim 1, wherein:

the control circuitry is further configured to activate the motor upon receipt of reset command;

the control circuitry activates the motor to drive the gear member in a first direction when the control circuitry receives the door open command; and the control circuitry activates the motor to drive the gear member in a second direction when the control circuitry receives the reset command.

10. The door opening system of claim 1, wherein:

the resilient member comprises a projection for engaging with the gear member.

11. A microwave oven comprising:

a housing;

a door providing access to the housing;

a latch system for retaining the door in a closed position with respect to the housing and releasing the door to an open position with respect to the housing;

a microwave source;

an interlock switch system for disabling the microwave source when the door is in the open position; and a door opening mechanism comprising:

a door opening command interface;

a resilient member for urging the door from the closed position to the open position, wherein the resilient member is free from contact with the latch system and the interlock switch system;

a gear member configured to engage with the resilient member to cause the resilient member to urge the door from the closed position to the open position;

control circuitry configured to electronically activate the gear member upon receipt of a door open command signal.

12. The microwave oven of claim 11, wherein:

the resilient member comprises a pin; and the pin moves in a substantially horizontal direction to push the door from the closed position to the open position.

13. The microwave oven of claim 11, wherein the resilient member comprises:

a first end configured to contact the door; and a second end configured to engage with the gear member.

14. The microwave oven of claim 11, wherein:

the gear member comprises a plurality of teeth for engaging the resilient member;

the door opening mechanism further comprises a motor for driving the gear member; and the motor is configured to rotate the gear member to engage the resilient member with at least one of the plurality of teeth.

15. The microwave oven of claim 14, further comprising:

a biasing member coupled to the resilient member, wherein the biasing member is configured to maintain the resilient member in a position free from contact with the door until engagement; and wherein:

engagement of the resilient member with a first tooth of the gear pushes the resilient member into contact with the door to urge the door from the closed position to the open position; and after engagement, the biasing member causes the resilient member to return to the position free from contact with the door.

16. A system for opening a door of an appliance, the system comprising:

a door opening command interface;

a resilient member for urging the door from a closed position to an open position, wherein the resilient member is free from contact with a door latch system and an interlock switch system of the appliance;

a gear member configured to engage with the resilient member to cause the resilient member to urge the door from the closed position to the open position;

a motor configured to drive the gear member; and control circuitry configured to:

receive a door opening command signal from the door opening command interface;

activate the motor to drive the gear member;

receive a door open signal from the interlock switch system of said appliance; and activate the motor to move the gear member into a reset position.

17. The system of claim 16, wherein the control circuitry is further configured to:

activate the motor in a first direction to drive the gear member; and activate the motor in a second direction to move the gear member into the reset position.

18. The system of claim 16, wherein:

the resilient member comprises a pin that is driven against the door; and the gear member includes at least one tooth that engages with the resilient member to drive the pin.

* * * * *